US009528380B2

(12) United States Patent
Weber et al.

(10) Patent No.: US 9,528,380 B2
(45) Date of Patent: Dec. 27, 2016

(54) TURBINE BUCKET AND METHOD FOR COOLING A TURBINE BUCKET OF A GAS TURBINE ENGINE

(71) Applicant: General Electric Company, Schenectady, NY (US)

(72) Inventors: Joseph A. Weber, Simpsonville, SC (US); Stephen P. Wassynger, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 472 days.

(21) Appl. No.: 14/132,481

(22) Filed: Dec. 18, 2013

(65) Prior Publication Data

US 2015/0167493 A1 Jun. 18, 2015

(51) Int. Cl.
*F01D 5/18* (2006.01)

(52) U.S. Cl.
CPC ..... *F01D 5/187* (2013.01); *F01D 5/186* (2013.01); *F05D 2260/202* (2013.01)

(58) Field of Classification Search
CPC ..... F01D 5/186; F01D 5/187; F05D 2260/20; F05D 2260/202
USPC ..... 415/115; 416/90 R, 91, 92, 96 R, 96 A, 416/97 R, 231 B
See application file for complete search history.

(56) References Cited

U.S. PATENT DOCUMENTS

| | | | | |
|---|---|---|---|---|
| 2,679,669 | A * | 6/1954 | Kempe | B22C 9/04 106/38.3 |
| 4,726,735 | A * | 2/1988 | Field | F01D 5/186 415/115 |
| 5,690,472 | A * | 11/1997 | Lee | F01D 5/187 416/95 |
| 5,980,209 | A | 11/1999 | Barry et al. | |
| 6,241,471 | B1 * | 6/2001 | Herron | F01D 5/147 415/173.1 |
| 6,981,840 | B2 * | 1/2006 | Lee | F01D 5/187 415/115 |
| 6,997,679 | B2 | 2/2006 | Beddard et al. | |
| 7,901,180 | B2 | 3/2011 | Abdel-Messeh et al. | |
| 2005/0047914 | A1 | 3/2005 | Tomberg | |
| 2009/0324424 | A1 * | 12/2009 | Tragesser | F01D 5/18 416/97 R |
| 2010/0003127 | A1 * | 1/2010 | Reeves | F01D 5/187 415/177 |
| 2011/0171023 | A1 * | 7/2011 | Lee | F01D 5/187 416/1 |
| 2011/0250078 | A1 | 10/2011 | Bruce et al. | |
| 2013/0039777 | A1 * | 2/2013 | Piggush | F01D 5/186 416/97 R |

* cited by examiner

*Primary Examiner* — Christopher Verdier
(74) *Attorney, Agent, or Firm* — Sutherland Asbill & Brennan LLP

(57) ABSTRACT

A turbine bucket for a gas turbine engine may include a platform, an airfoil extending radially outward from the platform, and a number of cooling passages defined at least partially within the airfoil. At least one of the cooling passages may extend radially to an outlet defined in an outer surface of the airfoil radially inward from a tip end of the turbine bucket.

20 Claims, 6 Drawing Sheets

TURBINE BUCKET AND METHOD FOR COOLING A TURBINE BUCKET OF A GAS TURBINE ENGINE

TECHNICAL FIELD

The present application thus provides a turbine bucket for a gas turbine engine. The turbine bucket may include a platform, an airfoil extending radially outward from the platform, and a number of cooling passages defined at least partially within the airfoil. At least one of the cooling passages may extend radially to an outlet defined in an outer surface of the airfoil radially inward from a tip end of the turbine bucket.

BACKGROUND OF THE INVENTION

In a gas turbine engine, hot combustion gases generally may flow from one or more combustors through a transition piece and along a hot gas path of a turbine. A number of turbine stages typically may be disposed in series along the hot gas path so that the combustion gases flow through first-stage nozzles and buckets and subsequently through nozzles and buckets of later stages of the turbine. In this manner, the nozzles may direct the combustion gases toward the respective buckets, causing the buckets to rotate and drive a load, such as an electrical generator and the like. The combustion gases may be contained by circumferential shrouds surrounding the buckets, which also may aid in directing the combustion gases along the hot gas path. In this manner, the turbine nozzles, buckets, and shrouds may be subjected to high temperatures resulting from the combustion gases flowing along the hot gas path, which may result in the formation of hot spots and high thermal stresses in these components. Because the efficiency of a gas turbine engine is dependent on its operating temperatures, there is an ongoing demand for components positioned along the hot gas path, such as turbine buckets, to be capable of withstanding increasingly higher temperatures without failure or decrease in useful life.

Certain turbine buckets may include one or more passages defined within the turbine bucket for cooling purposes. For example, cooling passages may be defined within the airfoil, the platform, the shank, and/or the tip shroud of the turbine bucket, depending on the specific cooling needs of the bucket, as may vary from stage to stage of the turbine. According to certain configurations, the cooling passages may be defined within regions near a hot gas path surface of the turbine bucket. In this manner, the cooling passages may transport a cooling fluid, such as compressor discharge or extraction air, through desired regions of the turbine bucket for exchanging heat in order to maintain the temperature of the regions within an acceptable range.

According to one known configuration, the turbine bucket may include a number of long, straight cooling passages each extending radially from the root end to the tip end of the turbine bucket. The cooling passages may be formed by various methods, such as drilling. However, root-to-tip cooling passages formed by drilling are limited to a straight path through the turbine bucket. Accordingly, variation of the three-dimensional shape of the turbine bucket, specifically the airfoil portion thereof, may be limited due to the need to accommodate a straight line of sight for each of the cooling passages extending radially therethrough and to maintain a minimum wall thickness. Moreover, placement of the straight cooling passages near a hot gas path surface, such as along the trailing edge of the airfoil, may be challenging due to the aerodynamic shape of the airfoil. Further, for longer turbine buckets, it may be particularly challenging and costly to drill the cooling passages through the entire length of the bucket, due to high length-to-diameter ratios of the passages.

According to another known configuration, the turbine bucket may include a number cooling passages each having two straight portions connected to one another. Specifically, a first portion may extend from the root end of the turbine bucket, while a second portion extends from the tip end of the turbine bucket to the first portion. The two straight portions of the cooling passage may meet within the platform of the turbine bucket or elsewhere. According to yet another known configuration, the turbine bucket may include a number of straight cooling passages each extending radially from the tip end of the turbine bucket to a cooling cavity defined within the shank of the turbine bucket. In this manner, the cooling passages are shorter than the length of the turbine bucket. Although these configurations may reduce some of the challenges associated with root-to-tip cooling passages, they still may significantly limit the three-dimensional shape of the airfoil, may limit the cooling effectiveness in desired zones, and may be challenging and costly to manufacture.

There is thus a desire for an improved turbine bucket having a cooling passage configuration for cooling the turbine bucket at high operating temperatures. Specifically, such a cooling passage configuration may allow the turbine bucket, specifically the airfoil portion thereof, to have various complex three-dimensional shapes or twist for improved aerodynamics. Such a cooling passage configuration also may allow for optimal placement of the cooling passages for targeted cooling of the limiting section of the airfoil, while also minimizing the cost and complexity of manufacturing the turbine bucket. Ultimately, such a cooling passage configuration may improve efficiency and performance of the turbine and the overall gas turbine engine.

SUMMARY OF THE INVENTION

The present application thus provides a turbine bucket for a gas turbine engine. The turbine bucket may include a platform, an airfoil extending radially outward from the platform, and a number of cooling passages defined at least partially within the airfoil. At least one of the cooling passages may extend radially to an outlet defined in an outer surface of the airfoil radially inward from a tip end of the turbine bucket.

The present application further provides a method for cooling a turbine bucket used in a gas turbine engine. The method may include the step of passing a flow of cooling fluid through a number of cooling passages defined at least partially within an airfoil of the turbine bucket, wherein at least one of the cooling passages may extend radially to an outlet defined in an outer surface of the airfoil radially inward from a tip end of the turbine bucket. The method also may include the step of exhausting the flow of cooling fluid through the outlet of the at least one of the cooling passages and into a hot gas path.

The present application further provides a gas turbine engine. The gas turbine engine may include a compressor, a combustor in communication with the compressor, and a turbine in communication with the combustor. The turbine may include a number of turbine buckets arranged in a circumferential array. Each of the turbine buckets may include a platform, an airfoil extending radially outward from the platform, and a number of cooling passages defined at least partially within the airfoil. At least one of the cooling passages may extend radially to an outlet defined in an outer surface of the airfoil radially inward from a tip end of the turbine bucket.

These and other features and improvements of the present application will become apparent to one of ordinary skill in the art upon review of the following detailed description when taken in conjunction with the several drawings and the appended claims.

The present application and the resultant patent further provide a gas turbine engine. The gas turbine engine may include a compressor, a combustor in communication with the compressor, and a turbine in communication with the combustor. The turbine may include a number of turbine buckets arranged in a circumferential array. Each of the turbine buckets may include a platform, an airfoil extending radially outward from the platform, and a number of cooling passages defined at least partially within the airfoil. At least one of the cooling passages may extend radially to an outlet defined in an outer surface of the airfoil radially inward from a tip end of the turbine bucket.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
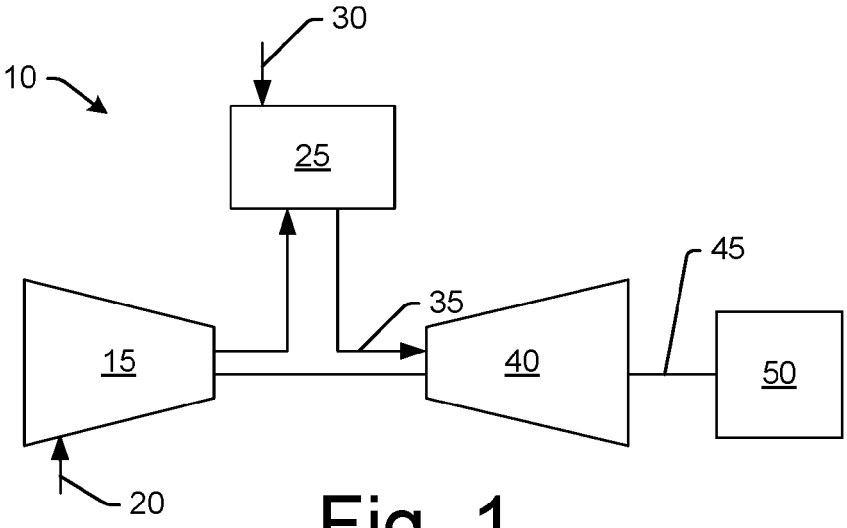
FIG. 1 is a schematic diagram of a gas turbine engine including a compressor, a combustor, and a turbine.

Referring now to the drawings, in which like numerals refer to like elements throughout the several views, FIG. 1 shows a schematic diagram of a gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. Other configurations and other components may be used herein.

The gas turbine engine 10 may use natural gas, various types of syngas, and/or other types of fuels. The gas turbine engine 10 may be any one of a number of different gas turbine engines offered by General Electric Company of Schenectady, New York, including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together. Although the gas turbine engine 10 is shown herein, the present application may be applicable to any type of turbo machinery, such as a steam turbine engine.

Figure 2:
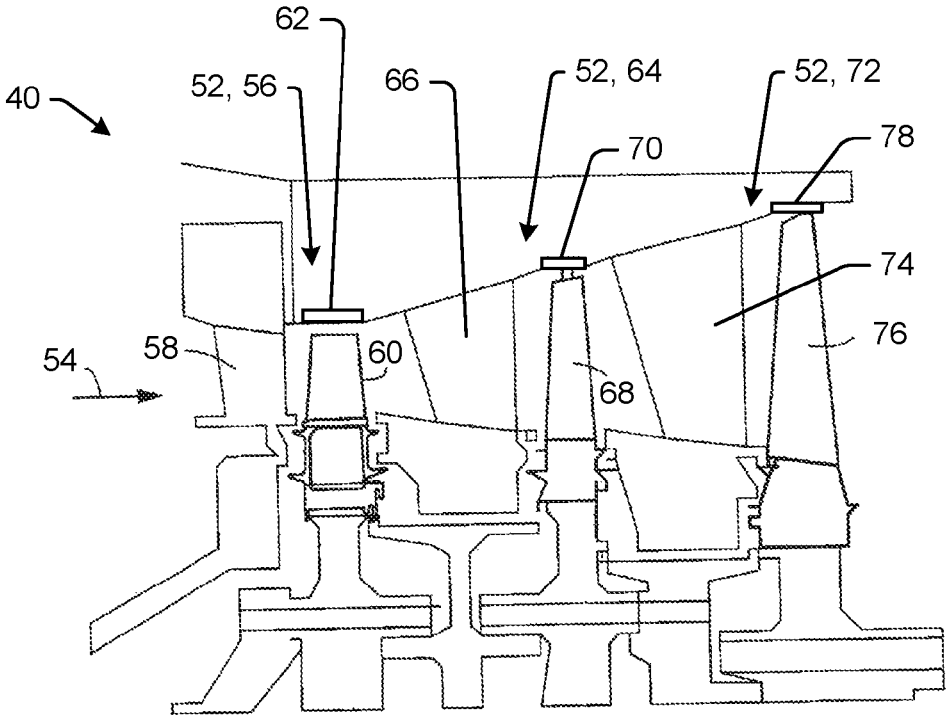
FIG. 2 is a schematic diagram of a portion of a turbine as may be used in the gas turbine engine of FIG. 1, showing a number of turbine stages.

FIG. 2 shows a schematic diagram of a portion of the turbine 40 including a number of stages 52 positioned in a hot gas path 54 of the gas turbine engine 10. A first stage 56 may include a number of circumferentially-spaced first-stage nozzles 58 and a number of circumferentially-spaced first-stage buckets 60. The first stage 56 also may include a first-stage shroud 62 extending circumferentially and surrounding the first-stage buckets 60. The first-stage shroud 62 may include a number of shroud segments positioned adjacent one another in an annular arrangement. In a similar manner, a second stage 64 may include a number of second-stage nozzles 66, a number of second-stage buckets 68, and a second-stage shroud 70 surrounding the second-stage buckets 68. Further, a third stage 72 may include a number of third-stage nozzles 74, a number of third-stage buckets 76, and a third-stage shroud 78 surrounding the third-stage buckets 76. Although the portion of the turbine 40 is shown as including three stages 52, the turbine 40 may include any number of stages 52.

Figure 3:
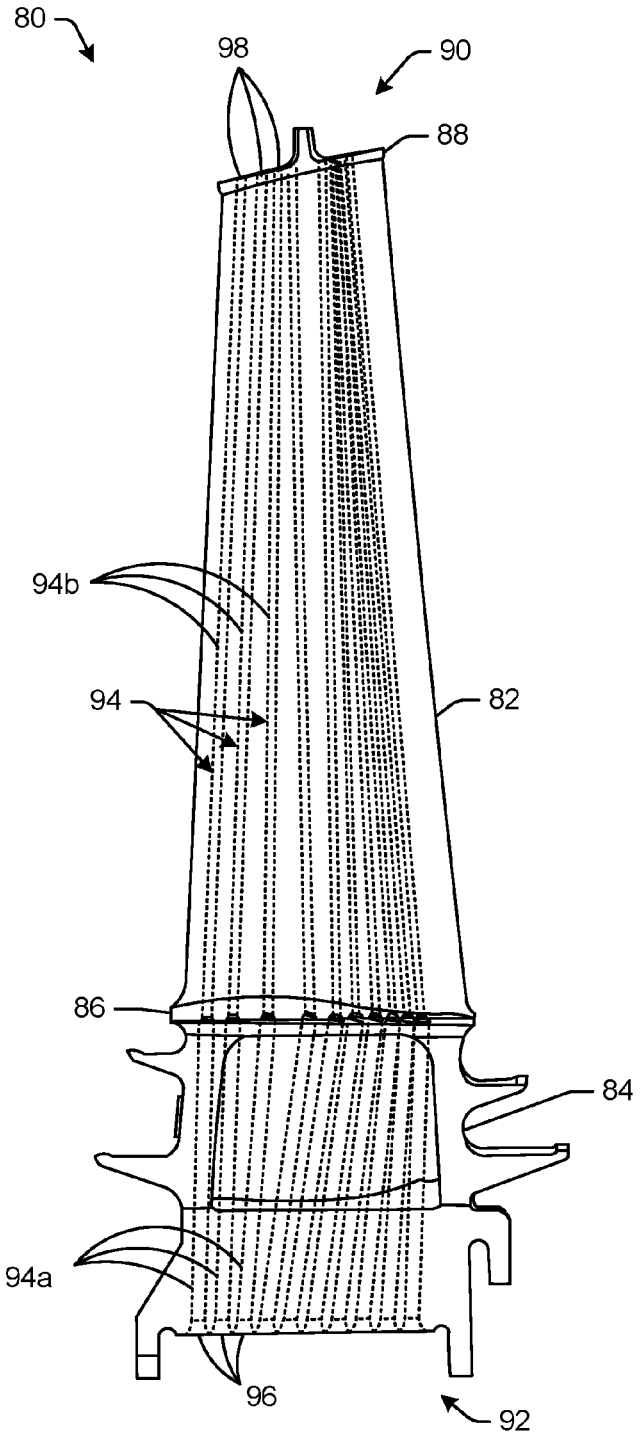
Fig. 3 Prior Art
FIG. 3 is a front plan view of a known turbine bucket as may be used in the turbine of FIG. 2, showing a number of cooling passages illustrated by hidden lines.
Figure 4:
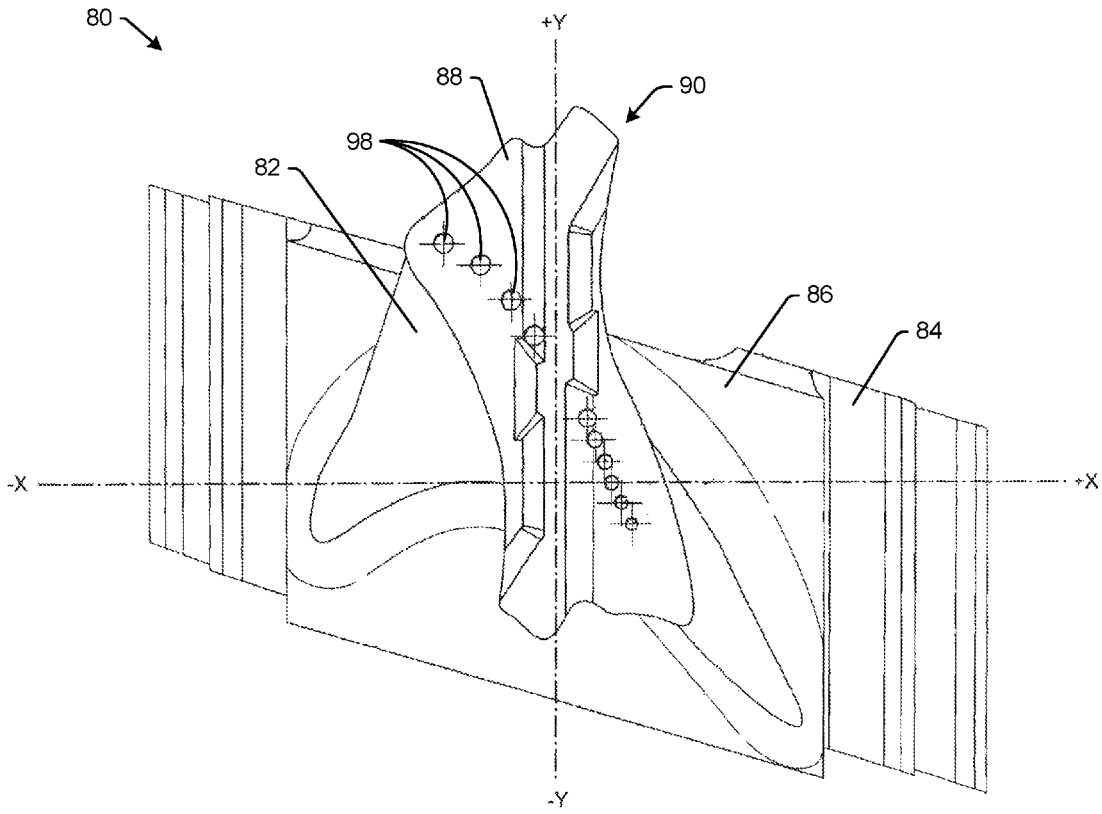
Fig. 4 Prior Art
FIG. 4 is a top plan view of the turbine bucket of FIG. 3.

FIGS. 3 and 4 show a known turbine bucket 80 as may be used in one of the stages 52 of the turbine 40. For example, the bucket 80 may be used in the second stage 64 or a later stage of the turbine 40. Generally described, the turbine bucket 80 may include an airfoil 82, a shank 84, and a platform 86 disposed between the airfoil 82 and the shank 84. As described above, a number of the buckets 80 may be arranged in a circumferential array within the stage 52 of the turbine 40. In this manner, the airfoil 82 of each bucket 80 may extend radially with respect to a central axis of the turbine 40, while the platform 86 of each bucket 80 extends circumferentially with respect to the central axis of the turbine 40.

As is shown, the airfoil 82 may extend radially outward from the platform 86 to a tip shroud 88 positioned about a tip end 90 of the bucket 80. In some embodiments, the tip shroud 88 may be integrally formed with the airfoil 82. The shank 84 may extend radially inward from the platform 86 to a root end 92 of the bucket 80, such that the platform 86 generally defines an interface between the airfoil 82 and the shank 84. As is shown, the platform 86 may be formed so as to extend generally parallel to the central axis of the turbine 40 during operation thereof. The shank 84 may be formed to define a root structure, such as a dovetail, configured to secure the bucket 80 to a turbine disk of the turbine 40. During operation of the turbine 40, the flow of combustion gases 35 travels along the hot gas path 54 and over the platform 86, which along with an outer circumference of the turbine disk forms the radially inner boundary of the hot gas path 54. Accordingly, the flow of combustion gases 35 is directed against the airfoil 82 of the bucket 80, and thus the surfaces of the airfoil 82 are subjected to very high temperatures.

As is shown in FIGS. 3 and 4, the turbine bucket 80 may include a number of cooling passages 94 (illustrated via hidden lines) defined within the bucket 80. Each cooling passage 94 may include a first straight portion 94*a* extending from an inlet 96 defined in the root end 92 of the bucket 80. Each cooling passage 94 also may include a second straight portion 94*b* extending from the first straight portion 94*a* to an outlet 98 defined in the tip end 90 of the bucket 80. The first straight portion 94*a* and the second straight portion 94*b* may meet at an interface within the platform 86 of the bucket 80, as is shown. The portions 94*a*, 94*b* of the cooling passages 94 may be formed by conventional STEM drilling techniques. During operation of the turbine 40, a cooling fluid, such as discharge or extraction air from the compressor 15, may be directed into the inlets 96 and subsequently may pass through the cooling passages 94 and exit the bucket 80 via the outlets 98. Accordingly, heat may transfer from surrounding regions of the bucket 80, particularly the airfoil 82, to the cooling fluid as it passes through the cooling passages 94 and then is directed into the hot gas path 54 at the tip end 90 of the bucket 80.

Figure 5:
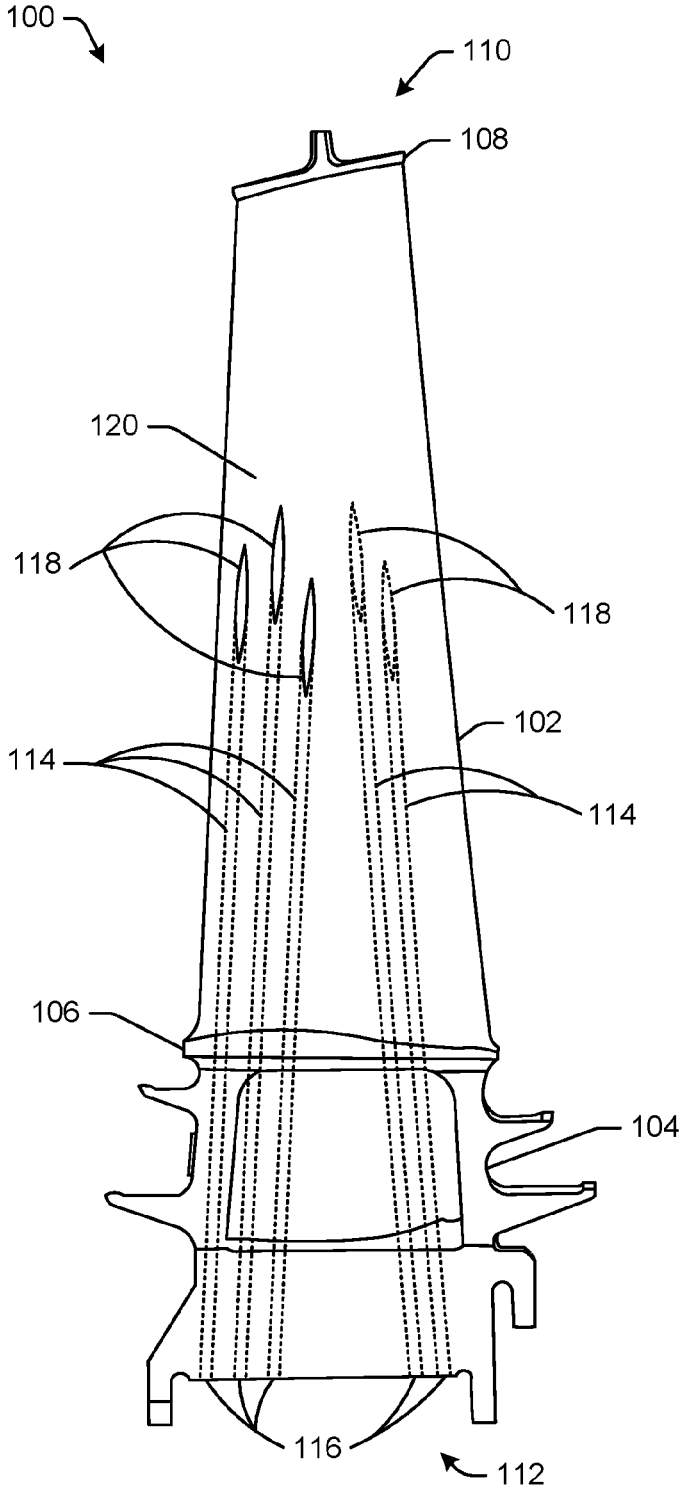
FIG. 5 is a front plan view of one embodiment of a turbine bucket as may be described herein and as may be used in the turbine of FIG. 2, showing a number of cooling passages illustrated by hidden lines.
Figure 6:
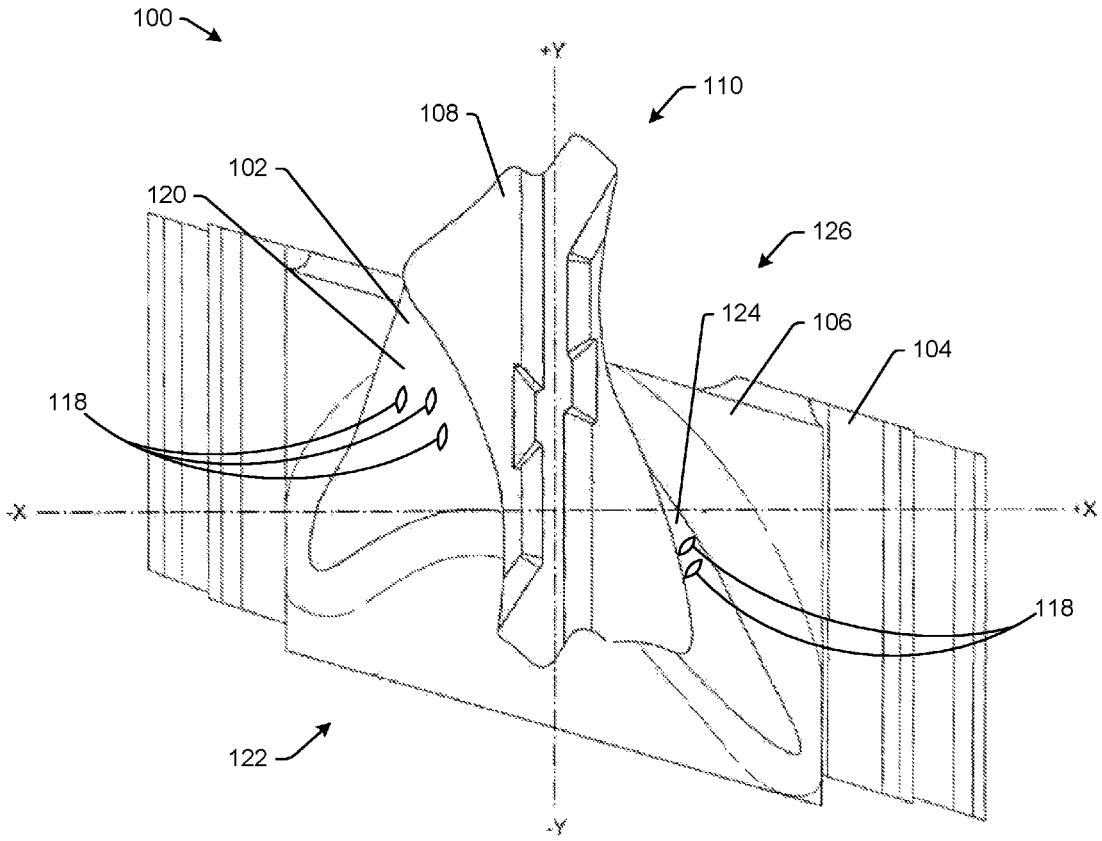
FIG. 6 is a top plan view of the turbine bucket of FIG. 5.

FIGS. 5 and 6 show one embodiment of a turbine bucket 100 as may be described herein. The turbine bucket 100 may be used in one of the stages 52 of the turbine 40 and generally may be configured in a manner similar to the turbine bucket 80 described above, although certain differences in structure and function are described herein below. For example, the bucket 100 may be used in the second stage 64 or a later stage of the turbine 40. As is shown, the bucket 100 may include an airfoil 102, a shank 104, and a platform 106 disposed between the airfoil 102 and the shank 104. A number of the buckets 100 may be arranged in a circumferential array within the stage 52 of the turbine 40. In this manner, the airfoil 102 of each bucket 100 may extend radially with respect to a central axis of the turbine 40, while the platform 106 of each bucket 100 extends circumferentially with respect to the central axis of the turbine 40.

As is shown, the airfoil 102 may extend radially outward from the platform 106 to a tip shroud 108 positioned about a tip end 110 of the bucket 100. In some embodiments, the tip shroud 108 may be integrally formed with the airfoil 102. The shank 104 may extend radially inward from the platform 106 to a root end 112 of the bucket 100, such that the platform 106 generally defines an interface between the airfoil 102 and the shank 104. As is shown, the platform 106 may be formed so as to extend generally parallel to the central axis of the turbine 40 during operation thereof. The shank 104 may be formed to define a root structure, such as a dovetail, configured to secure the bucket 80 to a turbine disk of the turbine 40. During operation of the turbine 40, the flow of combustion gases 35 travels along the hot gas path 54 and over the platform 106, which along with an outer circumference of the turbine disk forms the radially inner boundary of the hot gas path 54. Accordingly, the flow of combustion gases 35 is directed against the airfoil 102 of the bucket 100, and thus the surfaces of the airfoil 102 are subjected to very high temperatures.

As is shown in FIGS. 5 and 6, the turbine bucket 100 may include a number of cooling passages 114 (illustrated via hidden lines) defined within the bucket 100. Specifically, the cooling passages 114 may be defined at least partially within the airfoil 102 of the bucket 100. At least one of the cooling passages 114 may extend radially from an inlet 116 defined in the root end 112 of the bucket 100 to an outlet 118 defined in an outer surface of the airfoil 102 radially inward from the tip end 110 of the bucket 100. In this manner, the at least one of the cooling passages 114 may begin at the inlet 116 and may terminate at the outlet 118. In some embodiments, each of the cooling passages 114 may extend radially from a respective inlet 116 defined in the root end 112 of the bucket 100 to a respective outlet 118 defined in an outer surface of the airfoil 102 radially inward from the tip end 110 of the bucket 100. In this manner, each of the cooling passages 114 may begin at the respective inlet 116 and may terminate at the respective outlet 118. As is shown, the inlets 116 of the cooling passages 114 may be defined in the shank 104 of the bucket 100. In some embodiments, at least one of the outlets 118 of the cooling passages 114 may be defined in a pressure side surface 120 of the airfoil 102, corresponding to a pressure side 122 of the bucket 100. Further, in some embodiments, at least one of the outlets 118 of the cooling passages 114 may be defined in a suction side surface 124 of the airfoil 102, corresponding to a suction side 126 of the bucket 100. According to some embodiments, the bucket 100 may include at least one cooling passage 114 extending radially to a respective outlet 118 defined in the outer surface of the airfoil 102 radially inward from the tip end 110 of the bucket 100, and also may include at least one cooling passage 114 extending radially to a respective outlet 118 defined in the tip end 110 of the bucket 100.

As is shown, a portion of the airfoil 102 extending radially outward from the outlets 118 of the cooling passages 114 may be solid. In some embodiments, as is shown in FIG. 5, the outlets 118 of the cooling passages 114 may be defined in the outer surface of the airfoil 102 at locations between 50% and 70% of a radial length of the airfoil 102 from the platform 106, although other locations are possible. In such embodiments, the portion of the airfoil 102 extending between 70% and 100% of the radial length of the airfoil 102 from the platform 106 may or may not be solid. In some embodiments, the tip shroud 108 extending radially outward from the airfoil 102 may be solid. The cooling passages 114 may be formed by conventional drilling techniques or other methods of manufacture.

During operation of the turbine 40, a cooling fluid, such as discharge or extraction air from the compressor 15, may be directed into the inlets 116 and subsequently may pass through the cooling passages 114. The cooling fluid may be exhausted through the outlets 118 of the cooling passages 114 and into the hot gas path 54. Accordingly, heat may transfer from surrounding regions of the bucket 100, particularly a radially inward portion of the airfoil 102, to the cooling fluid as it passes through the cooling passages 114 and then is exhausted into the hot gas path 54 along the airfoil 102.

Figure 7:
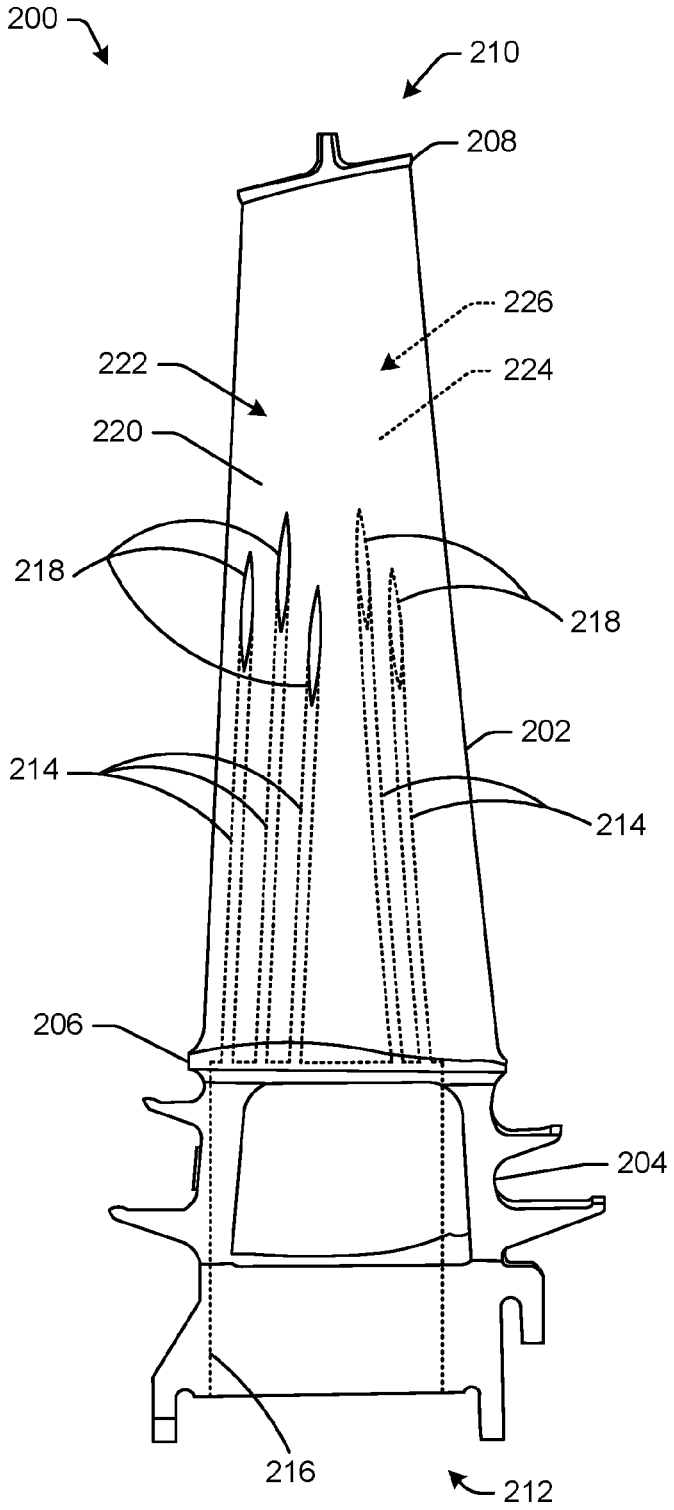
FIG. 7 is a front plan view of another embodiment of a turbine bucket as may be described herein and as may be used in the turbine of FIG. 2, showing a number of cooling passages and a cooling cavity illustrated by hidden lines.

FIG. 7 shows another embodiment of a turbine bucket 200 as may be described herein. The turbine bucket 200 may include various features corresponding to those described above with respect to the turbine bucket 100, which features are identified in FIG. 7 with corresponding numerals and are not described in further detail herein below. The turbine bucket 200 may be used in one of the stages 52 of the turbine 40 and may include an airfoil 202, a shank 204, a platform 206, a tip shroud 208, a tip end 210, and a root end 212.

As is shown, the turbine bucket 200 may include a number of cooling passages 214 and at least one cooling cavity 216 (illustrated via hidden lines) defined within the bucket 200. Specifically, the cooling passages 214 may be defined at least partially within the airfoil 202 of the bucket 200, and the cooling cavity 216 may be defined at least partially within the shank 204 of the bucket 200. At least one of the cooling passages 214 may extend radially from the cooling cavity 216 to an outlet 218 defined in an outer surface of the airfoil 202 radially inward from the tip end 210 of the bucket 200. In this manner, the cooling passage 214 may begin at the cooling cavity 216 and may terminate at the outlet 218. In some embodiments, each of the cooling passages 214 may extend radially from the cooling cavity 216 to a respective outlet 218 defined in an outer surface of the airfoil 202 radially inward from the tip end 210 of the bucket 200. In this manner, each of the cooling passages 214 may begin at the cooling cavity 216 and may terminate at the respective outlet 218. As is shown, the cooling passages 214 may be in communication with the cooling cavity 216 at an interface positioned within the platform 206. In some embodiments, at least one of the outlets 218 of the cooling passages 214 may be defined in a pressure side surface 220 of the airfoil 202, corresponding to a pressure side 222 of the bucket 200. Further, in some embodiments, at least one of the outlets 218 of the cooling passages 214 may be defined in a suction side surface 224 of the airfoil 202, corresponding to a suction side 226 of the bucket 200. According to some embodiments, the bucket 200 may include at least one cooling passage 214 extending radially to a respective outlet 218 defined in the outer surface of the airfoil 202 radially inward from the tip end 210 of the bucket 100, and also may include at least one cooling passage 214 extending radially to a respective outlet 218 defined in the tip end 210 of the bucket 200.

During operation of the turbine 40, a cooling fluid, such as discharge or extraction air from the compressor 15, may be directed into the cooling cavity 216 and subsequently may pass through the cooling passages 214. The cooling fluid may be exhausted through the outlets 218 of the cooling passages 214 and into the hot gas path 54. Accordingly, heat may transfer from surrounding regions of the bucket 200, particularly a radially inward portion of the airfoil 202, to the cooling fluid as it passes through the cooling passages 214 and then is exhausted into the hot gas path 54 along the airfoil 202.

The embodiments described herein thus provide an improved turbine bucket including a cooling passage configuration for cooling the turbine bucket at high operating temperatures. As described above, the turbine bucket may include a number of cooling passages defined at least partially within an airfoil, wherein at least one of the cooling passages extends radially to an outlet defined in an outer surface of the airfoil radially inward from a tip end of the bucket. Therefore, the cooling passages may be configured to direct a flow of cooling fluid through a portion of the airfoil and to exhaust the cooling fluid into the hot gas path along the airfoil. In this manner, the cooling passage configuration may allow the turbine bucket, specifically the airfoil, to have various complex three-dimensional shapes or twist for improved aerodynamics. The cooling passage configuration also may allow for optimal placement of the cooling passages for targeted cooling of the limiting section of the airfoil, while also minimizing the cost and complexity of manufacturing the turbine bucket. Ultimately, the cooling passage configuration may allow the turbine bucket to withstand high operating temperatures without deterioration, failure, or decrease in useful life, and may enhance efficiency and performance of the turbine and overall gas turbine engine.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine bucket for a gas turbine engine, the turbine bucket comprising:

a platform;

an airfoil extending radially outward from the platform; and a plurality of cooling passages each defined at least partially within the platform and the airfoil, wherein at least one of the cooling passages extends radially along a straight path to an outlet defined in an outer surface of the airfoil radially inward from a tip end of the turbine bucket.

2. The turbine bucket of claim 1, further comprising a shank extending radially inward from the platform, wherein the at least one of the cooling passages extends radially along the straight path from an inlet defined in an outer surface of the shank to the outlet.

3. The turbine bucket of claim 1, further comprising a shank extending radially inward from the platform, and a cooling cavity defined at least partially within the shank, wherein the at least one of the cooling passages extends radially along the straight path from the cooling cavity to the outlet.

4. The turbine bucket of claim 3, wherein the at least one of the cooling passages is in communication with the cooling cavity at an interface positioned within the platform.

5. The turbine bucket of claim 1, wherein the outlet of the at least one of the cooling passages is defined in a pressure side surface of the airfoil.

6. The turbine bucket of claim 1, wherein the outlet of the at least one of the cooling passages is defined in a suction side surface of the airfoil.

7. The turbine bucket of claim 1, wherein each of the cooling passages extends radially along a straight path to an outlet defined in the outer surface of the airfoil radially inward from the tip end of the turbine bucket.

8. The turbine bucket of claim 1, wherein the outlet of the at least one of the cooling passages is defined in the outer surface of the airfoil at a location between 50% and 70% of a radial length of the airfoil from the platform.

9. The turbine bucket of claim 8, wherein a portion of the airfoil extending between 70% and 100% of the radial length of the airfoil from the platform is solid.

10. The turbine bucket of claim 1, wherein a portion of the airfoil extending radially outward from the outlet of the at least one of the cooling passages is solid.

11. The turbine bucket of claim 1, further comprising a tip shroud extending radially outward from the airfoil, wherein the tip shroud is solid.

12. A method for cooling a turbine bucket used in a gas turbine engine, comprising:

passing a flow of cooling fluid through a plurality of cooling passages each defined at least partially within a platform and an airfoil of the turbine bucket, wherein at least one of the cooling passages extends radially along a straight path to an outlet defined in an outer surface of the airfoil radially inward from a tip end of the turbine bucket; and exhausting the flow of cooling fluid through the outlet of the at least one of the cooling passages and into a hot gas path.

13. The method of claim 12, wherein exhausting the flow of cooling fluid through the outlet of the at least one of the cooling passages comprises exhausting the flow of cooling fluid along a pressure side surface of the airfoil.

14. The method of claim 12, wherein exhausting the flow of cooling fluid through the outlet of the at least one of the cooling passages comprises exhausting the flow of cooling fluid along a suction side surface of the airfoil.

15. The method of claim 12, wherein exhausting the flow of cooling fluid through the outlet of the at least one of the cooling passages comprises exhausting the flow of cooling fluid at a location between 50% and 70% of a radial length of the airfoil from the platform.

16. A gas turbine engine, comprising:

a compressor;

a combustor in communication with the compressor; and a turbine in communication with the combustor, the turbine comprising a plurality of turbine buckets arranged in a circumferential array, each of the turbine buckets comprising:

a platform;

an airfoil extending radially outward from the platform; and a plurality of cooling passages each defined at least partially within the platform and the airfoil, wherein at least one of the cooling passages extends radially along a straight path to an outlet defined in an outer surface of the airfoil radially inward from a tip end of the turbine bucket.

17. The gas turbine engine of claim 16, wherein the outlet of the at least one of the cooling passages is defined in a pressure side surface of the airfoil.

18. The gas turbine engine of claim 16, wherein the outlet of the at least one of the cooling passages is defined in a suction side surface of the airfoil.

19. The gas turbine engine of claim 16, wherein the outlet of the at least one of the cooling passages is defined in the outer surface of the airfoil at a location between 50% and 70% of a radial length of the airfoil from the platform.

20. The gas turbine engine of claim 16, wherein a portion of the airfoil extending radially outward from the outlet of the at least one of the cooling passages is solid.

* * * * *